United States Patent [19]

Smith

[11] 4,297,865

[45] Nov. 3, 1981

[54] METAL STRIP DOWNCOILERS

[75] Inventor: William Smith, Burlington, Canada

[73] Assignee: The Steel Company of Canada, Ltd., Hamilton, Canada

[21] Appl. No.: 130,718

[22] Filed: Mar. 17, 1980

[30] Foreign Application Priority Data

Mar. 30, 1979 [CA] Canada ..... 11180

[51] Int. Cl.[3] ..... B21C 47/00

[52] U.S. Cl. ..... 72/146; 72/231; 242/78.7

[58] Field of Search ..... 72/146, 148, 231, 171, 72/250, 366, 168, 169; 242/78.7, 78.1

[56] References Cited

U.S. PATENT DOCUMENTS

| | | | |
|---|---|---|---|
| 2,078,005 | 4/1937 | Lloyd | 72/168 |
| 2,150,934 | 3/1939 | Millan | 72/146 |
| 2,179,011 | 11/1939 | Hudson | 72/146 |
| 3,805,570 | 4/1974 | Smith | 242/78.7 |
| 4,005,830 | 2/1977 | Smith | 72/146 |
| 4,019,359 | 4/1977 | Smith | 72/146 |

*Primary Examiner*—Gene P. Crosby
*Attorney, Agent, or Firm*—Sim & McBurney

[57] ABSTRACT

There is provided an apparatus and method for selectively coiling a transfer bar or allowing the bar to pass uncoiled through the apparatus. A frame supports a number of rollers which can transfer a bar in one direction, and conventional bend roller means are located above the rollers, adapted to apply a down curvature to a transfer bar. Pivotal ramp means upstream of the bend roller means can either direct a transfer bar through the bend roller means, or allow the transfer bar to pass along the rollers under the bend roller means. A displaceable roller downstream of the bend roller means and parallel with the rest of the rollers is provided, and is mounted for displacement normal to its axis in a direction having a vertical component, whereby the roller may be moved between a first position in which it lies even with the rest of the rollers, and a second position in which it is raised above the level of the rest of the rollers. The displaceable roller defines an angle with two rollers sequentially downstream from it, the vertex of the angle being at the adjacent downstream roller, whereby the angle changes from 180° to an obtuse angle as the displaceable roller moves from its first to its second position. The displaceable roller in the second position defines, with the two sequentially downstream rollers, a cradle in which the convolutions of a coiling transfer bar can be contained. This cradle is capable of enlargement to accommodate the expanding coil, by lowering the displaceable roller toward its first position.

4 Claims, 3 Drawing Figures

METAL STRIP DOWNCOILERS

This invention relates generally to coilers for use with the rolling of hot metal workpieces, and has particularly to do with coiler apparatus not requiring a central mandrel.

The conventional method of rolling hot metal strip involves heating an ingot or slab to approximately 2300° F. (for steel) and reducing it in thickness by rolling it through a series of rolling mill stands. Normally the rolling sequence takes place in two stages referred to as roughing and finishing.

In the roughing stage, the slab or ingot normally is rolled through one or more rolling mill stands in a series of passes until it is reduced in thickness to a transfer bar approximately 1" thick. The roughing mill stage may also include one or more vertical edging mills.

Following the roughing operation, the transfer bar normally is transferred on table rolls to a continuous finishing mill train where it is further reduced to the desired gauge.

Because there are certain problems inherent in the normal method of rolling hot metal strip just described, particularly arising from the long length of time that it takes the transfer bar to feed into the finishing mill train, recent developments have been made for temporarily "storing" a hot metal strip (transfer bar) in an open-centred coil configuration between the rolling stages, for example between the roughing mill and the finishing mill.

U.S. Pat. No. 4,019,359, issued Apr. 26, 1977 to The Steel Company of Canada, Limited, and U.S. Pat. No. 4,005,830, issued Feb. 1, 1977 also to The Steel Company of Canada, Limited, relate to the construction and operation of what is called a downcoiler, capable of rolling the strip or transfer bar about itself into a coreless coil in which the heat contained in the strip is largely retained, and is not allowed to dissipate away. Numerous other advantages are inherent in the downcoiler system, and these are explained in detail in the preamble to the above-mentioned U.S. patents.

The present application relates to a further improvement in downcoilers capable of rolling a strip or transfer bar about itself in a coreless manner. In particular, the improvement disclosed herein relates to the desirability of being able to place the downcoiler portion of the mechanism "into line" or "out of line" at will, in order to have the option of either coiling a strip or transfer bar at an intermediate location between two rolling stages, or passing the strip or transfer bar directly from one stage to the other without the intermediate step of coiling the strip about itself.

Generally speaking, the apparatus adapted to accomplish the downcoiling is heavy and cumbersome, and any proposal to simply crane the apparatus or a large part of it upwardly away from the roller bed is less than practical, due to the energy and time considerations involved.

Accordingly, this application provides several means of quickly and economically placing a downcoiler apparatus "in line" or "out of line" as desired by the operator.

More specifically, this invention provides apparatus for selectively (a) coiling a hot steel transfer bar or (b) allowing the bar to pass uncoiled through the apparatus, comprising:

frame means supporting a plurality of aligned rollers for transferring a bar in one direction, bend roller means located above said plurality of rollers and being adapted to apply a down curvature to a transfer bar passing therethrough, ramp means upstream of the bend roller means with respect to said one direction and adapted selectively a) to be placed in the path of a transfer bar to cause the latter to be deflected upwardly to enter said bend roller means, or b) to allow the transfer bar to pass along said rollers under said bend roller means, a displaceable roller downstream of the bend roller means and parallel with the rest of the rollers, said displaceable roller being mounted for displacement normal to its axis in a direction having a vertical component, whereby the roller may be moved between a first position in which it lies even with the rest of the rollers, and a second position in which it is raised above the level of the rest of the rollers, said displaceable roller defining an angle with the two rollers sequentially downstream of it, the vertex of the angle being at the adjacent downstream roller, whereby the angle changes from 180° to an obtuse angle as the displaceable roller moves from its first to its second position, said displaceable roller in said second position defining, with said two sequentially donwstream rollers, a cradle in which the convolutions of a coiling transfer bar can be contained, the cradle being capable of enlargement to accommodate the expanding coil by lowering the displaceable roller toward its first position.

Further, this invention provides a method of coiling a transfer bar, comprising:

(a) providing an apparatus having frame means supporting a plurality of rollers along which a transfer bar can be passed in one direction, bend roller means located above said plurality of rollers, and a displaceable roller downstream of the bend roller means with respect to said one direction, the displaceable roller being mounted for movement between a first position in which it lies even with the rest of the rollers and a second position in which it is raised above the level of the rest of the rollers, said displaceable roller defining an angle with the two rollers sequentially downstream of it, the vertex of the angle being at the adjacent downstream roller, whereby the angle becomes smaller as the displaceable roller is raised, the rollers defining said angle constituting a cradle in which the convolutions of a coiling transfer bar can be contained, (b) moving said displaceable roller to its second position, (c) passing a transfer bar through said bend roller means, thereby curling the transfer bar, (d) passing the transfer bar downwardly from the bend roller means to initiate coiling of the transfer bar in the said cradle, (e) continuing the coiling of the curled transfer bar in said cradle, thereby increasing the radius of the coil and the weight applied to the rollers defining the cradle, and (f) moving the displaceable roller toward its first position to allow the greater coil radius to be accommodated in said cradle.

In the figures, all of which are schematic:

Figure 1:
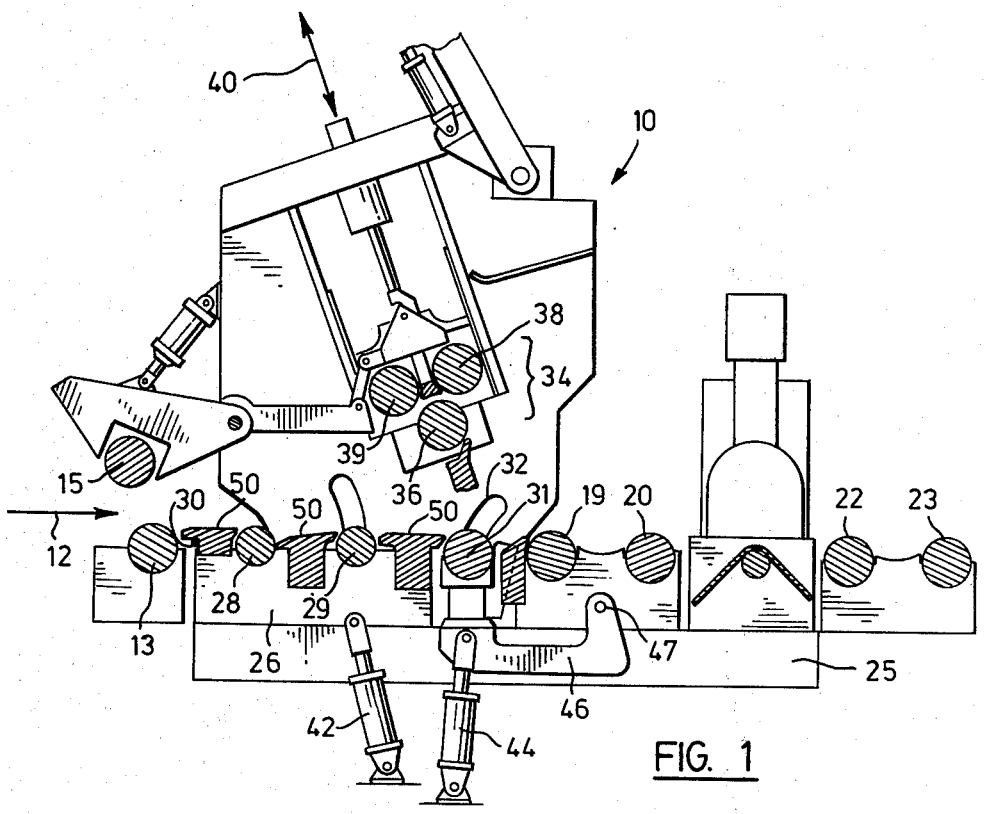
FIG. 1 is a vertical sectional view of a modified downcoiler apparatus, taken in the direction of movement of the transfer bar, and showing the apparatus in a first position, in which the transfer bar is allowed to pass through the apparatus without being coiled.

In FIG. 1, a downcoiler apparatus generally designated by the numeral 10 is adapted to receive transfer bars or steel strip moving in the direction identified by the arrow 12. At the left in FIG. 1, bottom and top entry pinch rolls 13 and 15 respectively are adapted to grip the leading edge of a transfer bar and propel it forwardly, whenever the rolls 13 and 15 are in a gripping juxtaposition. In FIG. 1 these rolls are shown separated. Running rightwardly from the bottom entry pinch roll 13 are a series of additional rollers, some of which are fixed in axial position, others of which are movable. The fixed rollers are numbered 13, 19, 20, 22 and 23. The word "fixed" here means the axis is fixed with respect to the main frame 25. A sub-frame 26 supports two movable rollers 28 and 29 which are fixed with respect to the sub-frame 26. The sub-frame is itself pivotal about a point 30 approximately at the upper lefthand corner thereof, allowing pivotal motion of the sub-frame 26 to the position shown in FIG. 2.

Figure 2:
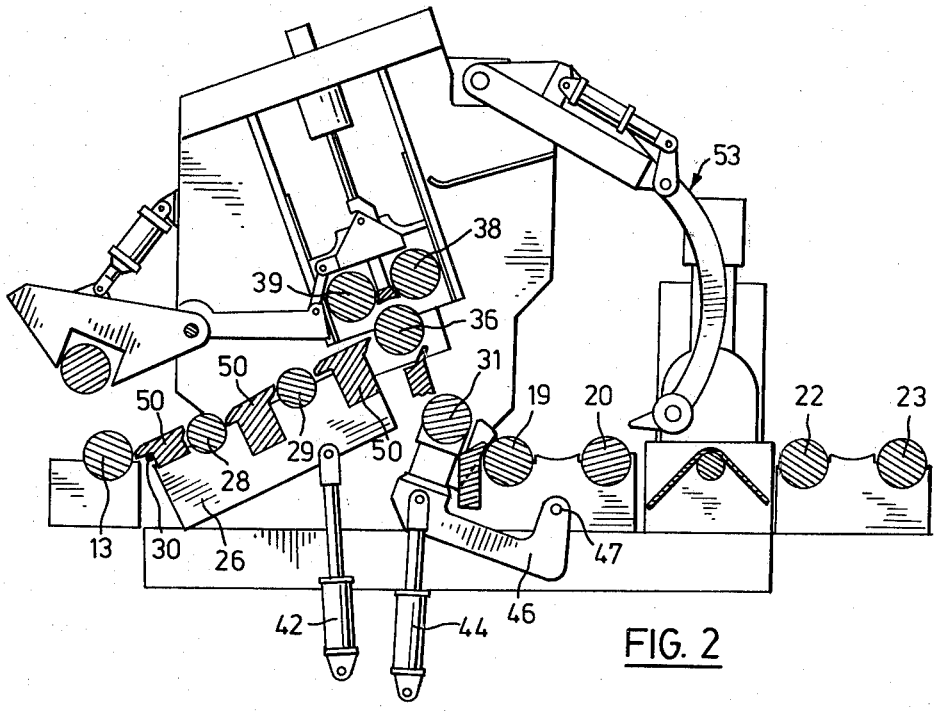
FIG. 2 is a view similar to FIG. 1, but showing the apparatus in a position to coil the transfer bar.

Still referring to FIG. 1, a roller 31 is guided in an arcuate track 32 for movement from a first position being that shown in FIG. 1, to a second position being that shown in FIG. 2. In FIG. 2, the roller 31 is raised above and displaced slightly to the right of its original position shown in FIG. 1.

Again referring to FIG. 1, a bend roll assembly is generally referred to by the numeral 34, this assembly being known from the prior U.S. patents referred to above. The bend roll assembly includes a lower roll 36, and two upper rolls 38 and 39, both of which are movable toward and away from the lower roll 36, in the direction shown by the double-headed arrow 40. Adjustment of the position of the upper bend rolls 38 and 39 with respect to the lower bend roll 36 allows adjustment of the degree of curvature impressed into the transfer bar.

It will now be understood that the FIG. 1 disposition of the various elements already described will allow a transfer bar or other steel strip to pass straight through from left to right in the direction of the arrow 12, without being passed through the bend rolls and coiled into a coreless coil. In the position of FIG. 2, a first hydraulic member 42 rocks the sub-frame 26 in the counterclockwise direction into its second position, and a second hydraulic member 44 rocks a rocker arm 46 about a pivot point 47 to raise the roller 31 from its lowermost position shown in FIG. 1 to its uppermost position shown in FIG. 2. It will be appreciated that the centre of curvature of the arcuate track 32 is at the pivot point 47.

When the apparatus is in the FIG. 2 condition, guide plates 50 affixed to the sub-frame 26 between and on either side of the rollers 28 and 29 help to guide the transfer bar along the direction from the lower pinch roll 13 to the bottom bend roll 36. The transfer bar, however, would primarily ride upon the rollers 28 and 29.

Additionally, by positioning the roll 31 in its uppermost location as shown in FIG. 2, there is defined a generally curvilinear "ring" of rollers, which includes rollers 19 and 20, against which the bent transfer bar can begin to coil itself.

A further advantage of the apparatus arrangement shown in FIGS. 1 and 2 relates also to the shifting roll 31. Under certain conditions, the bent leading edge of the transfer bar will begin to coil itself against only the two rollers 19 and 31, with the diameter of the coil initially being too small to touch all three rollers 19, 20 and 31. As the coil increases in size, its outer curvature decreases, and its weight increases. A point will be reached where it is preferable to have the weight taken squarely by the rollers 19 and 20, and at this point the roll 31 can be utilized to "shift" the coil onto the rolls 19 and 20. For this mode of operation, it would be understood that initially the roll 31 would not be in its uppermost position, but would be at some intermediate location.

A peeler arm is generally shown by the numeral 53, and is useful to separate the outer convolution from the next inner convolution after the coil has been completely wound up, and is about to be unwound with the previous trailing edge becoming the leading edge. However, the arm 53 plays no part in the present invention.

Figure 3:
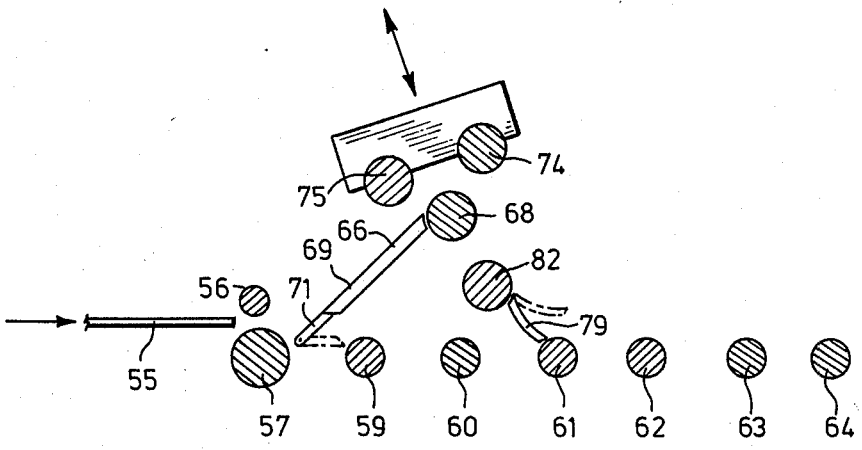
FIG. 3 is a vertical sectional view through an alternative embodiment showing a different means of accomplishing the optional "in-out" positioning of the downcoiler apparatus.

Attention is now directed to FIG. 3, which is a more simplified drawing than either of FIGS. 1 and 2, and shows a different embodiment which is adapted to allow a transfer bar 55 to pass from right to left either directly through the apparatus without being coiled, or up between bend rolls in order to be coiled. Entry pinch rolls 56 and 57 are provided at the right of the portions illustrated in FIG. 3, and a series of fixed rollers 59–64 are shown running from right to left. A chute 66 is provided with its upper end terminating adjacent a lower bend roll 68, and its lower end terminating at 69, sufficiently above the level of tops of the rollers 57 and 59–64 to allow a transfer bar 55 to pass underneath when desired. The element which determines whether the transfer bar 55 passes under the chute 66 or not is an apron 71, which is shown in the up position in solid lines, and in the down position in broken lines. The apron 71 when in position as shown in solid lines will deflect the leading edge of the transfer bar 55 upwardly onto the chute 66, thence through the bend rolls 68, 74 and 75. When in the down position shown in broken lines in FIG. 3, the apron 71 allows the transfer bar 55 to pass leftwardly underneath the chute 66. A further apron 79 is also shown in FIG. 3, being located between the roll 61 and a raised roll 82 situated beneath and somewhat to the left of the lower bend roll 68. The rolls 61, 62 and 82 form a triangular cradle or nesting location for the coil formed at the bending rolls. When the apron 79 is in the solid line position shown in FIG. 3, it promotes the smooth coiling of the strip by preventing the leading edge of the strip from catching under the roller 82. In the dotted line position shown in FIG. 3, the apron 79 allows an unbent and uncoiled strip 55 to pass directly through the apparatus from right to left.

I claim:

1. Apparatus for selectively (a) coiling a hot steel transfer bar or (b) allowing the bar to pass uncoiled through the apparatus, comprising:

frame means supporting a plurality of aligned rollers for transferring a bar in one direction, bend roller means located above said plurality of rollers and being adapted to apply a down curvature to a transfer bar passing therethrough, ramp means upstream of the bend roller means with respect to said one direction and adapted selectively (a) to be placed in the path of a transfer bar to cause the latter to be deflected upwardly to enter said bend roller means, or (b) to allow the transfer bar to pass along said rollers under said bend roller means, a displaceable roller downstream of the bend roller means and parallel with the rest of the rollers, said displaceable roller being mounted for displacement normal to its axis in a direction having a vertical component, whereby the roller may be moved between a first position in which it lies even with the rest of the rollers, and a second position in which it is raised above the level of the rest of the rollers, said displaceable roller defining an angle with two rollers sequentially downstream of it, the vertex of the angle being at the adjacent downstream roller, whereby the angle changes from 180° to an obtuse angle as the displaceable roller moves from its first to its second position, said displaceable roller in said second position defining, with said two sequentially downstream rollers, a cradle in which the convolutions of a coiling transfer bar can be contained, the cradle being capable of enlargement to accommodate the expanding coil by lowering the displaceable roller toward its first position.

2. The apparatus claimed in claim 1, in which the said displaceable roller is mounted on an arm pivoted with respect to said frame means at a location generally downstream of the displaceable roller, such that the movement of the latter is along an arc of a circle, the apparatus including hydraulic means for rotating said arm about its pivot location.

3. The apparatus claimed in claim 1 or claim 2, in which said ramp means includes a sub-frame having upstream and downstream ends, supporting a plurality of rollers, the sub-frame being pivoted adjacent its upstream end for movement between a first position in which its rollers lie even with the rest of the rollers of the assembly, and a second position in which its rollers extend in alignment obliquely toward the bend roller means, whereby a transfer bar can be directed obliquely upwardly to the bend roller means, the apparatus further including hydraulic means for moving said sub-frame between its first and second positions.

4. A method of coiling a transfer bar, comprising:

(a) providing an apparatus having frame means supporting a plurality of rollers along which a transfer bar can be passed in one direction, bend roller means located above said plurality of rollers, and a displaceable roller downstream of the bend roller means with respect to said one direction, the displaceable roller being mounted for movement between a first position in which it lies even with the rest of the rollers and a second position in which it is raised above the level of the rest of the rollers, said displaceable roller defining an angle with two rollers sequentially downstream of it, the vertex of the angle being at the adjacent downstream roller, whereby the angle becomes smaller as the displaceable roller is raised, the rollers defining said angle constituting a cradle in which the convolutions of a coiling transfer bar can be contained, (b) moving said displaceable roller to its second position, (c) passing a transfer bar through said bend roller means, thereby curling the transfer bar, (d) passing the transfer bar downwardly from the bend roller means to initiate coiling of the transfer bar in the said cradle, (e) continuing the coiling of the curled transfer bar in said cradle, thereby increasing the radius of the coil and the weight applied to the rollers defining the cradle, and (f) moving the displaceable roller toward its first position to allow the greater coil radius to be accommodated in said cradle.

* * * * *

UNITED STATES PATENT AND TRADEMARK OFFICE

CERTIFICATE OF CORRECTION

PATENT NO. : 4,297,865

DATED : November 3, 1981

INVENTOR(S) : William Smith

It is certified that error appears in the above-identified patent and that said Letters Patent is hereby corrected as shown below:

On The Title Page, Item (30) should read

-- (30) Foreign Application Priority Data

Mar. 30, 1979 (GB) United Kingdom.....11180 --.

Column 4, line 30, "right" should read -- left --.

Column 4, line 32, "right to left" should read -- left to right --.

Column 4, line 46, "leftwardly" should read -- rightwardly --.

Column 4, line 57, "right to left" should read -- left to right --.

Column 4, after line 57, insert the final paragraph:

-- The improved structure provided herein not only eliminates the time and energy which would have been needed to crane a coilbox out of the way of a roller train, but it has the resultant benefit of increasing mill productivity. Furthermore,

UNITED STATES PATENT AND TRADEMARK OFFICE

CERTIFICATE OF CORRECTION

PATENT NO. : 4 ,297,865

DATED : November 3, 1981

INVENTOR(S) : William Smith

It is certified that error appears in the above-identified patent and that said Letters Patent is hereby corrected as shown below:

it conserves heat and reduces scrap, such that, in the event of a need to do maintenance work on a coilbox, transfer bars which have been previously heated partially or totally can continue to be produced through the mill while maintenance is being done on the coilbox. --.

Signed and Sealed this

*Twenty-first* Day of *September 1982*

[SEAL]

*Attest:*

GERALD J. MOSSINGHOFF

*Attesting Officer*

*Commissioner of Patents and Trademarks*